United States Patent [19]

Ingemansson et al.

[11] Patent Number: 4,569,471

[45] Date of Patent: Feb. 11, 1986

[54] CONTAINER THROUGH WHICH A GAS FLOWS, PREFERABLY A MUFFLER, WITH FIBERGLASS FILLING AND METHOD AND APPARATUS FOR FILLING THE SAME

[75] Inventors: Bengt-Erik Ingemansson, Olofström; Bertil E. Björk; Jan E. Hedman, both of Falkenberg; Knut G. Knutsson, Simlångsdalen; Nils H. I. Larsson, Falkenberg, all of Sweden

[73] Assignee: AB Volvo, Gothenburg, Sweden

[21] Appl. No.: 477,654

[22] Filed: Mar. 22, 1983

[30] Foreign Application Priority Data

Apr. 6, 1982 [SE] Sweden ..... 8202197

[51] Int. Cl.[4] ..... B65B 31/00

[52] U.S. Cl. ..... 228/176; 28/273; 226/97; 141/7; 141/11

[58] Field of Search ..... 228/176; 226/97; 28/273, 103; 65/2; 181/258; 141/7, 11

[56] References Cited

U.S. PATENT DOCUMENTS

| | | | |
|---|---|---|---|
| 2,499,018 | 2/1950 | Christiano et al. | 181/258 |
| 3,281,913 | 11/1966 | Morehead et al. | 28/289 X |
| 3,317,296 | 5/1967 | Irwin et al. | 65/2 |
| 3,678,579 | 7/1972 | Slavik | 226/97 X |
| 3,977,060 | 8/1976 | Ishikawa | 29/163.5 F |
| 4,148,676 | 4/1979 | Paquette et al. | 28/103 X |
| 4,215,805 | 8/1980 | Nielsen | 226/97 |

FOREIGN PATENT DOCUMENTS 190656 7/1964 Sweden .

*Primary Examiner*—Kenneth J. Ramsey
*Attorney, Agent, or Firm*—Young & Thompson

[57] ABSTRACT

The invention relates to a container for fiberglass wool, as well as a method and apparatus for producing a continuous length of fiberglass wool and for filling the container through which a gas flows, e.g. a muffler, with said wool. The apparatus comprises a feeder means which advances multifiber thread to a nozzle into which compressed air is blown which imparts movement to the thread at the same time as the fibers of the thread are blown apart and entangled so as to form continuous wool. The wool is blown directly into the container while air is evacuated by a suction fan.

11 Claims, 3 Drawing Figures

Figure 1:
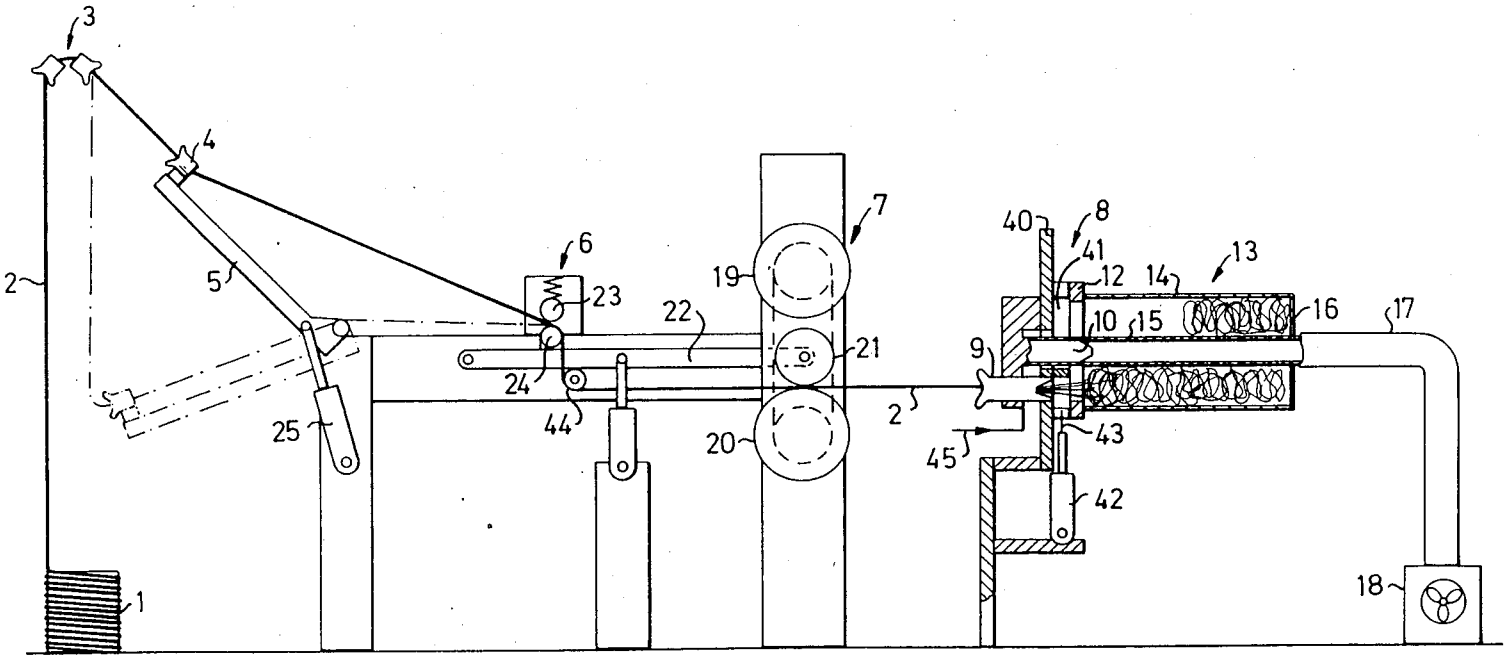

CONTAINER THROUGH WHICH A GAS FLOWS, PREFERABLY A MUFFLER, WITH FIBERGLASS FILLING AND METHOD AND APPARATUS FOR FILLING THE SAME

The present invention relates firstly to a container through which gas flows, preferably a muffler for a combustion engine, with a space containing fiberglass wool, secondly a method for inserting the fiberglass wool into the space and thirdly an apparatus for carrying out the method.

In vehicle mufflers, consisting of an outer cylindrical container with an inner perforated tube extending through the end pieces of the cylindrical container, fiberglass wool is often used as a noise dampening filler material, which is packed in the intermediate space between the cylinder and the tube. Up to now fiberglass wool has been used, delivered in finished form to the muffler manufacturer in the form of expanded, cut fiberglass with a fiber length of 50 mm. The muffler is filled with the aid of pneumatic devices which comprise heavy pipes and powerful fans.

Disadvantages of using finished fiberglass wool are that the equipment for filling the mufflers requires much space and that it is difficult to achieve even filling. Uneven filling with short-fiber fiberglass wool can result in the wool being packed against the cylindrical inner wall due to the effect of the exhaust gases, so that the noise muffling properties deteriorate even after a short period of time.

The purpose of the present invention is to achieve a container filled with fiberglass wool, especially a muffler for combustion engines, which has improved mechanical properties over said known mufflers. A further purpose is to achieve a method and apparatus which simplify and reduce the cost of filling the container and which also provide more uniform quality.

This is achieved by a container of the type described which is characterized in that the fiberglass filling consists of at least one length of wool packed into the space.

A muffler filling consisting of one or more continuous lengths of fiberglass wool with at least substantially continuous fibers or filaments has greater resilience than a filling with short fibers and has less tendency to be packed by intermittent exhaust pressure against the walls of the muffler or be blown out through the perforations in the exhaust duct. This preserves the noise dampening properties for a longer operational period of time. A method of inserting fiberglass wool into a space in a container is characterized in that a multifilament fiberglass thread is fed into one end of a nozzle and is advanced through the nozzle with the aid of compressed air which is blown into the nozzle and causes the fibers of the thread to separate and become entangled, so that the thread emerges from the other end of the nozzle as a continuous length of fiberglass wool, which is blown by the effect of the compressed air through an opening into the container space at the same time as air is evacuated from the space.

The method according to the invention has a number of significant advantages over the method used up to now. One of the primary advantages is that the wool is first formed when it is blown into the container, thus eliminating the need for bulky storage and transport means for the wool. The transport cost between the fiberglass manufacturer and the muffler manufacturer will be lower, since thread has only a fraction of the volume of the corresponding expanded wool. Among additional advantages is the possibility of varying in a simple manner firstly the volumetric weight of the wool or the degree of expansion by varying the feed rate and/or the air velocity and/or the amount of air through the nozzle, and secondly varying the degree of packing in the container by varying the capacity of the evacuation means. By virtue of the fact that the amount of wool inserted can be precisely checked by measuring the length of thread advanced, it is easy to maintain uniform quality in mass production.

An apparatus for inserting the fiberglass wool into the container comprises a nozzle means with at least one nozzle which has an inlet and an outlet for a multifilament fiberglass thread and an intermediate chamber with a connection to a compressed air source, said nozzle being made so that the compressed air advances the thread through the nozzle and separates and entangles the filaments of the thread so that the thread when it emerges from the nozzle forms a continuous length of wool; feeder means arranged to advance the thread from a magazine to the nozzle means at a speed which is lower than the speed at which the compressed air strives to advance the thread through the nozzle; and a cutting means for the thread disposed immediately after the nozzle outlet.

Figure 3:
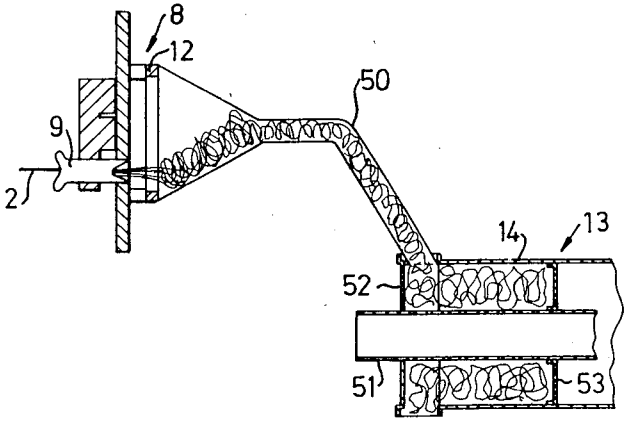
Figure 2:
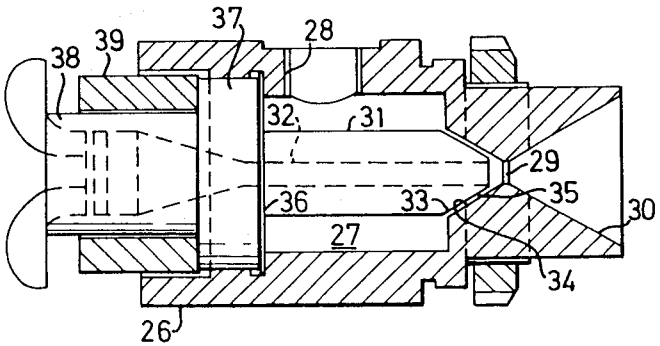

The invention will now be described in more detail with reference to example shown in the accompanying drawings. FIG. 1 shows a schematic sideview of an apparatus for filling a vehicle muffler with fiberglass wool. FIG. 2 shows a longitudinal section through a nozzle and FIG. 3 shows a modified arrangement for filling a muffler.

In FIG. 1, 1 designates a spool on which a fiberglass thread, e.g. roving 2, is wound. The thread runs via a fixed thread guide 3 and a guide 4 on a pivoting arm 5 through a clamping means 6 and via a breaker roller 44 to a feeder means 7, and from there to a nozzle means 8 which has a nozzle 9, a cylindrical guide 10 and a plate 12 with an opening after the nozzle. A muffler 13 consisting of an outer cylinder 14 and an inner perforated tube 15 is fixed to the nozzle means 8 by means not shown in more detail here. The lefthand end of the cylinder 14 is open and its edges abut the plate 12 while the guide 10 penetrates into the lefthand end of the perforated tube 15. The righthand end of the tube 15 penetrates through the righthand end piece 16 of the cylinder and is connected to a hose 17 which leads to a suction fan 18. The plate 12 is fixed to the supporting bracket 40 of the nozzle means 8 so that a gap 41 is formed between the plate 12 and the bracket. Through this gap, the surrounding air can flow in after the nozzle, so as to provide pressure equalization, i.e. so that essentially atmospheric pressure is maintained when air is blown in from the nozzle 9 at the same time as air is evacuated with the fan 18. By deflecting the thread over the breaker roller 44 instead of pulling it directly to the feeder means 7, the cohesive layer between the thread fibers is broken up.

The feeder means 7 consists of a pair of synchronously driven plastic-coated rollers 19,20 of equal size and an intermediate freely rotatably mounted hard metal roller 21 which is carried by pivot arms 22. In the position shown in the Figure, the roller 21 is in the thread-feed position, i.e. in contact with the lower roller 20 and with the thread pressed between the rollers. After the feeding-in has been completed, the roller 21 is swung by means of a compressed air cylinder 11 up into contact with the upper roller 19. The thread feed stops but the driving of the roller 21 is continued against the upper roller. This arrangement eliminates the need for a separate drive motor for the roller 21, at the same time as it guarantees that the roller 21 is continually driven at a speed adapted to the roller 20.

The clamping means 6 consists of a pair of non-rotatably mounted shafts 23,24, the upper one of which has a limited vertical movement and is biassed by a spring downwards. The lower shaft can be moved towards and away from the upper shaft to clamp or release the thread when the feed-in is completed or when starting a new feed.

When the feeding-in of the thread is stopped, the arm 5 swings down to the position shown with dash-dot lines by a compressed air cylinder 25 to take up the slack in the thread. When the feed has started again, the arm 5 swings back to its upper position.

Thread which has been drawn from the spool 1 by the feeder means 7 is introduced into the nozzle 9 to which there is connected a line 45 from a compressed air source (not shown). The nozzle 9, which is shown in more detail in FIG. 2, comprises a cylindrical housing 26, which defines a chamber 27 with a bore 28 for coupling of the compressed air line 45. The chamber has an outlet 29 which opens into a spout 30. A cylinder 31, with a bore 32 for the thread, extends axially through the chamber 27. The cylinder 31 has a conical end 33 which projects into a corresponding conical depression 34 in the righthand end wall of the chamber, thereby forming a conical gap 35 between the conical end 33 and the conical wall portion 34 of the chamber. The gap width is regulated by one or more intermediate washers 36 between a collar portion 37 on the cylinder 31 and an edge of the housing 26.

The lefthand portion 38 of the cylinder 31 forms a guide for the thread and is surrounded by a nut 39 which is screwed into a threaded bore in the housing and presses against the collar 37.

The air which is blown through the nozzle 9 will both impart a forward movement to the thread and blow apart and entangle the thread fibers so that the thread will emerge from the nozzle as a "wool sausage", i.e. as wool with substantially continuous fibers. The wool is blown directly into the muffler, and the blown-in air is evacuated by the fan 18. The degree of expansion of the wool is determined by factors such as rate of feed, air speed and the amount of air through the nozzle 9. The rate of feed of the feeder means 7 is however always regulated so that it is lower than the speed at which the air strives to feed the thread through the nozzle, so that the thread is always held under tension. When starting the process, the air to the nozzle is turned on before the feed means are started so that the thread is first tensioned. The degree of packing in the muffler is determined by the under-pressure in the muffler and can be varied by varying the capacity of the suction fan 18. The amount of fiber wool fed into the muffler is simply checked by measuring the length of thread fed in, either with the aid of a counter coupled to the feeder means which registers the number of rotations of the roller, or, if the rollers are always driven at the same rotational speed, by measuring the time. After filling with the desired amount of wool, the thread is cut by a cutting means immediately after the nozzle, in the form of a knife 43 driven by a compressed air cylinder 42.

When the muffler 13 is filled, it is moved to a station (not shown) for welding on the lefthand end piece. Since the wool has a tendency to expand when the suction is stopped, the muffler is moved to the welding station with the suction fan still coupled and in operation or else a cover plate is temporarily placed over the opening of the muffler before the hose 17 is disconnected to prevent the wool from coming out during transport.

FIG. 3 shows a modified method, in which the fiberglass wool is blown into the muffler 13 via a hose or drum 50, one end of which abuts against the plate 12 and the other end of which opens into a gap between the edge of the container 14 and an outer end piece 52 welded to a perforated tube 51. This method is applied when the outer and inner end pieces 52,53 are first welded fast to the tube 51 and are thereafter inserted as a package into the cylinder 14. The package is first inserted so far as to leave for example a 50 mm wide gap towards which the outer end of the drum is directed as shown in FIG. 3. When filling, the gap is closed at the sides of the drum 50 temporarily by means not shown here. After the filling is complete, the package is then pushed into its final position with the outer end piece abutting against the edge of the container. As in the preceding case, air is evacuated via the perforated tube during filling.

In the preceding, an apparatus has been described for producing continuous fiberglass wool and for filling a muffler with this wool, in which the nozzle means 8 has been shown as a single nozzle for the sake of simplicity.

The nozzle means 8 can however be provided with two or more nozzles 9 for two or more threads, which are advanced in parallel between the rollers of the feeder means. This makes possible more rapid and more even filling of mufflers without requiring more space for the apparatus. The apparatus can also be used for filling of other containers than mufflers with fiberglass wool and for mere production of continuous fiberglass wool for any purpose whatsoever, whereby the wool can be blown directly into a package.

We claim:

1. Method of inserting fiberglass wool into a space in a container, characterized in that a multifiber fiberglass thread is fed into one end of a nozzle and is advanced through the nozzle with the aid of compressed air which is blown into the nozzle and causes the fibers of the thread to separate and become entangled, so that the thread emerges from the other end of the nozzle as a continuous length of fiberglass wool, which is blown by the effect of the compressed air through an opening into the container space at the same time as air is evacuated from the space, there being a bonding agent between the fibers of the thread, and deflecting the thread to break up the bonding agent between the fibers of the thread before the thread is fed into the nozzle.

2. Method according to claim 1, characterized in that a thread with continuous filaments is fed into the nozzle.

3. Method according to claim 1, characterized in that the thread is advanced between a pair of feed rollers to the nozzle and that the velocity of the air through the nozzle is chosen so that the thread is held in tension between the rollers and the nozzle.

4. Method according to claim 3, characterized in that the filling process is initiated by starting the air flow to the nozzle before starting the thread feed between the rollers.

5. Method according to claim 3, characterized in that the amount of fiberglass wool in the container is measured by direct or indirect measurement of the length of the thread advanced between the rollers and that, when the desired amount has been reached, the feed between the rollers is stopped and the thread is cut at the outlet side of the nozzle.

6. Method according to claim 1, characterized in that the volumetric weight of the fiberglass wool is regulated by regulating one or more of the parameters feed rate, air velocity and amount of air through the nozzle.

7. Method according to claim 1, characterized in that the degree of packing of the fiberglass wool in the container is regulated by regulating the capacity of a suction fan connected to the container.

8. Method according to claim 1, characterized in that the container is mounted directly after the nozzle in such a manner that air from the surrounding atmosphere can flow in directly after the nozzle and into the container together with the air from the nozzle.

9. Method according to one claim 1, characterized in that the container is fixed against a support directly after the nozzle and that the fiberglass wool is blown from the nozzle directly into the container.

10. Method according to claim 1, characterized in that the fiberglass wool is blown into the container via a hose or drum.

11. Method of inserting fiberglass wool into a space in a container to be included in a noise muffling system for a combustion engine, the container having an inner gas duct with a wall through which there is at least some gas flow, comprising feeding a multifiber fiberglass thread into one end of a nozzle and advancing the thread through the nozzle with the aid of compressed air which is blown into the nozzle and causes the fibers of the thread to separate and become entangled, so that the thread emerges from the other end of the nozzle as a continuous length of fiberglass wool, blowing the fiberglass wool through an opening in the container into a space between the gas duct and the container jacket at the same time that air is evacuated from said space through perforations in the duct with the aid of a suction fan connected to the duct, and after filling of the container, sealing the container opening at the same time that air is evacuated from the space filled with fiberglass wool.

* * * * *